US007648760B2

(12) United States Patent
Hatanaka et al.

(10) Patent No.: US 7,648,760 B2
(45) Date of Patent: Jan. 19, 2010

(54) MICROSTRUCTURE AND METHOD OF MANUFACTURING THE SAME

(75) Inventors: Yusuke Hatanaka, Shizuoka (JP); Tadabumi Tomita, Shizuoka (JP); Yoshinori Hotta, Aichi (JP); Akio Uesugi, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 381 days.

(21) Appl. No.: 11/702,189

(22) Filed: Feb. 5, 2007

(65) Prior Publication Data

US 2008/0081173 A1 Apr. 3, 2008

(30) Foreign Application Priority Data

Feb. 28, 2006 (JP) ..... 2006-052758

(51) Int. Cl.
*C25D 11/06* (2006.01)
*B32B 3/26* (2006.01)

(52) U.S. Cl. ..... 428/304.4; 205/221; 205/172; 205/175; 205/324; 428/312.8; 428/313.9; 428/469; 428/550; 428/552; 428/689; 428/702

(58) Field of Classification Search ..... None
See application file for complete search history.

(56) References Cited

U.S. PATENT DOCUMENTS 4,152,222 A 5/1979 Cheetham et al.
5,486,283 A 1/1996 Mnich
6,325,909 B1 12/2001 Li et al.
2002/0145826 A1 10/2002 Zangari et al.
2005/0211566 A1 9/2005 Tomita et al.
2007/0235342 A1* 10/2007 Matsuo et al. ..... 205/175

FOREIGN PATENT DOCUMENTS

GB 2 158 098 A 11/1985
JP 2004-217961 A 8/2004
JP 2005-307341 A 11/2005
JP 2006-124827 A 5/2006

OTHER PUBLICATIONS

European Search Report dated Aug. 1, 2007.
Hideki Masuda et al., "Fabrication of Gold Nanodot Array Using Anodic Porous Alumina as an Evaporation Mask," Jpn. J. Appl. Phys. vol. 35(1996) pp. L126-L129; Part 2, No. 1B, Jan. 15, 1996.
Xin Wang et al., "Fabrication and Characterization of Anodic Aluminum Oxide Template," Microelectronic Engineering 66 (2003) 166-170.

* cited by examiner

*Primary Examiner*—Ling Xu
(74) *Attorney, Agent, or Firm*—Sughrue Mion, PLLC

(57) ABSTRACT

In a method of manufacturing a microstructure, an aluminum member having an aluminum substrate and a micropore-bearing anodized layer present on a surface of the aluminum substrate is subjected at least to, in order, a pore-ordering treatment which involves performing one or more cycles of a step that includes a first film dissolution treatment for dissolving 0.001 to 20 wt % of a material constituting the anodized layer and an anodizing treatment which follows the first film dissolution treatment; and a second film dissolution treatment for dissolving the anodized layer, thereby obtaining the microstructure having micropores formed on a surface thereof. This method enables a microstructure having an ordered array of pits to be obtained in a short period of time.

3 Claims, 2 Drawing Sheets

MICROSTRUCTURE AND METHOD OF MANUFACTURING THE SAME

BACKGROUND OF THE INVENTION

The present invention relates to a microstructure and its manufacturing method.

In the technical field of metal and semiconductor thin films, wires and dots, it is known that the movement of free electrons becomes confined at sizes smaller than some characteristic length, as a result of which singular electrical, optical and chemical phenomena become observable. Such phenomena are called "quantum mechanical size effects" or simply "quantum size effects." Functional materials which employ such singular phenomena are under active research and development. Specifically, materials having structures smaller than several hundred nanometers in size, typically called microstructures or nanostructures, are the subject of current efforts in material development.

Methods for manufacturing such microstructures include processes in which a nanostructure is directly manufactured by semiconductor fabrication technology, including micropatterning technology such as photolithography, electron beam lithography, or x-ray lithography.

Of particular note is the considerable amount of research being conducted today on processes for manufacturing nanostructures having an ordered microstructure.

One method of forming an ordered structure in a self-regulating manner is illustrated by an anodized alumina layer (anodized layer) obtained by subjecting aluminum to anodizing treatment in an electrolytic solution. It is known that a plurality of micropores having diameters of about several nanometers to about several hundreds of nanometers are formed in a regular arrangement within the anodized layer. It is also known that when a completely ordered arrangement is obtained by the self-pore-ordering treatment of this anodized layer, hexagonal columnar cells will be theoretically formed, each cell having a base in the shape of a regular hexagon centered on a micropore, and that the lines connecting neighboring micropores will form equilateral triangles.

Known examples of applications for such anodized layers having micropores include optical functional nanodevices, magnetic devices, luminescent supports and catalyst supports. For example, JP 2005-307341 A mentions that an anodized layer is applied to a Raman spectrometer by sealing pores with a metal and generating localized plasmon resonance.

A method is known in which pits serving as starting points for micropore formation in anodizing treatment are formed prior to anodizing treatment for forming such micropores. Formation of such pits facilitates controlling the micropore arrangement and variations in pore diameter within desired ranges.

A self-ordering method that makes use of the self-ordering nature in the anodized layer is known as a general method for forming pits. This is a method which enhances the orderliness by using the regularly arranging nature of micropores in the anodized layer and eliminating factors that may disturb an orderly arrangement.

As described in JP 2005-307341 A, the self-ordering method generally involves performing anodizing treatment, then immersion in a mixed aqueous solution of phosphoric acid and chromic (VI) acid, and thereafter performing anodizing treatment again.

SUMMARY OF THE INVENTION

However, the film removal step using a mixed aqueous solution of phosphoric acid and chromic (VI) acid has usually required an extended period of time (e.g., from several hours to well over ten hours) although the time required varies with the thickness of the anodized layer.

It is therefore an object of the invention to provide a microstructure-manufacturing method that is capable of obtaining in a short period of time a microstructure having an ordered array of pits. Another object of the invention is to provide the microstructure obtained by the manufacturing method described above.

The inventors have made intensive studies to achieve the above objects and found that a structure having an ordered array of pits can be obtained in a short period of time by sequentially performing a first film dissolution treatment in which an anodized layer is slightly dissolved; anodizing treatment; and a second film dissolution treatment in which the anodized layer is dissolved, instead of the film removal step using a mixed aqueous solution of phosphoric acid and chromic (VI) acid. The invention has been completed on the basis of such finding.

Accordingly, the invention provides the following (i) to (iii).

(i) A method of manufacturing a microstructure wherein an aluminum member having an aluminum substrate and a micropore-bearing anodized layer present on a surface of the aluminum substrate is subjected at least to, in order, a pore-ordering treatment which involves performing one or more cycles of a step that includes a first film dissolution treatment for dissolving 0.001 to 20 wt % of a material constituting the anodized layer and an anodizing treatment which follows the first film dissolution treatment; and a second film dissolution treatment for dissolving the anodized layer, thereby obtaining the microstructure having micropores formed on a surface thereof.

(ii) A microstructure obtained by the manufacturing method according to (i) above.

(iii) The microstructure according to (ii) above, wherein a degree of ordering of the micropores as defined by a formula (1):

$$\text{Degree of Ordering (\%)} = B/A \times 100 \quad (1)$$

(wherein A represents a total number of micropores in a measurement region; and B represents a number of specific micropores in the measurement region for which, when a circle is drawn so as to be centered on a center of gravity of a specific micropore and so as to be of a smallest radius that is internally tangent to an edge of another micropore, the circle includes centers of gravity of six micropores other than the specific micropore) is at least 50%.

The manufacturing method of the invention enables microstructures having an ordered array of pits to be obtained in a short period of time.

DETAILED DESCRIPTION OF THE INVENTION

The invention is described more fully below.

The invention provides a method of manufacturing a microstructure wherein an aluminum member having an aluminum substrate and a micropore-bearing anodized layer present on a surface of the aluminum substrate is subjected at least to, in order, a pore-ordering treatment which involves performing one or more cycles of a step that includes a first film dissolution treatment for dissolving 0.001 to 20 wt % of a material constituting the anodized layer and an anodizing treatment which follows the first film dissolution treatment; and a second film dissolution treatment for dissolving the anodized layer, thereby obtaining the microstructure having micropores formed on a surface thereof.

<Aluminum Member>

The aluminum member used in the invention has an aluminum substrate and a micropore-bearing anodized layer present on a surface of the aluminum substrate. Such an aluminum member may be obtained by performing anodizing treatment on at least one surface of the aluminum substrate.

FIGS. 1A to 1D are end views schematically showing an aluminum member and a microstructure for illustrating the inventive method of manufacturing microstructures.

Figure 1A:
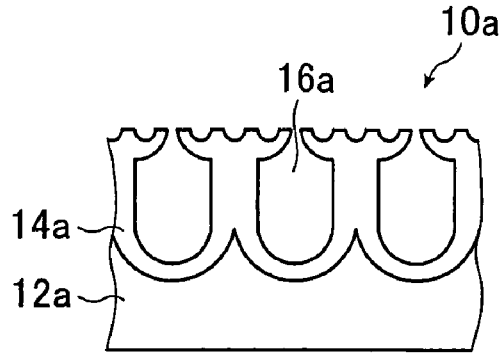
FIGS. 1A to 1D are end views schematically showing an aluminum member and a microstructure for illustrating the inventive method of manufacturing microstructures.

As shown in FIG. 1A, an aluminum member 10*a* includes an aluminum substrate 12*a* and an anodized layer 14*a* which is present on a surface of the aluminum substrate 12*a* and has micropores 16*a*.

<Aluminum Substrate>

The aluminum substrate is not subject to any particular limitation. Illustrative examples include pure aluminum plate; alloy plates composed primarily of aluminum and containing trace amounts of other elements; substrates made of low-purity aluminum (e.g., recycled material) on which high-purity aluminum has been vapor-deposited; substrates such as silicon wafers, quartz or glass whose surface has been covered with high-purity aluminum by a process such as vapor deposition or sputtering; and resin substrates on which aluminum has been laminated.

Of the aluminum substrate, the surface on which an anodized layer is provided by anodizing treatment has an aluminum purity of preferably at least 99.5 wt %, more preferably at least 99.9 wt % and even more preferably at least 99.99 wt %. At an aluminum purity within the above range, the pore arrangement will be sufficiently well-ordered.

It is preferable for the surface of the aluminum substrate to be subjected beforehand to degreasing and mirror-like finishing treatment.

If the microstructure obtained by the invention is to be used in applications that make use of its optical transparency, it is preferable that an aluminum substrate be subjected to heat treatment beforehand. Heat treatment will enlarge the region where the array of pores is highly ordered.

<Heat Treatment>

Heat treatment is preferably carried out at a temperature of from 200 to 350° C. for a period of about 30 seconds to about 2 minutes. The orderliness of the array of micropores formed in the subsequently described anodizing treatment is enhanced in this way. Following heat treatment, it is advantageous to rapidly cool the aluminum substrate. The method of cooling is exemplified by a method involving direct immersion of the aluminum substrate in water or the like.

<Degreasing>

Degreasing is carried out with a suitable substance such as an acid, alkali or organic solvent so as to dissolve and remove organic substances, including dust, grease and resins, adhering to the aluminum surface, and thereby prevent defects due to organic substances from arising in each of the subsequent treatments.

Known degreasers may be used in degreasing treatment. For example, degreasing may be carried out using any of various commercially available degreasers by the prescribed method.

Preferred methods include the following: a method in which an organic solvent such as an alcohol (e.g., methanol), a ketone, benzine or a volatile oil is brought into contact with the aluminum surface at ambient temperature (organic solvent method); a method in which a liquid containing a surfactant such as soap or a neutral detergent is brought into contact with the aluminum surface at a temperature of from ambient temperature to 80° C., after which the surface is rinsed with water (surfactant method); a method in which an aqueous sulfuric acid solution having a concentration of 10 to 200 g/L is brought into contact with the aluminum surface at a temperature of from ambient temperature to 70° C. for a period of 30 to 80 seconds, following which the surface is rinsed with water; a method in which an aqueous solution of sodium hydroxide having a concentration of 5 to 20 g/L is brought into contact with the aluminum surface at ambient temperature for about 30 seconds while electrolysis is carried out by passing a direct current through the aluminum surface as the cathode at a current density of 1 to 10 A/dm$^2$, following which the surface is brought into contact with an aqueous solution of nitric acid having a concentration of 100 to 500 g/L and thereby neutralized; a method in which any of various known anodizing electrolytic solutions is brought into contact with the aluminum surface at ambient temperature while electrolysis is carried out by passing a direct current at a current density of 1 to 10 A/dm or an alternating current through the aluminum surface as the cathode; a method in which an aqueous alkali solution having a concentration of 10 to 200 g/L is brought into contact with the aluminum surface at 40 to 50° C. for 15 to 60 seconds, following which the surface is brought into contact with an aqueous nitric acid solution having a concentration of 100 to 500 g/L and thereby neutralized; a method in which an emulsion prepared by mixing a surfactant, water or the like into an oil such as gas oil or kerosene is brought into contact with the aluminum surface at a temperature of from ambient temperature to 50° C., following which the surface is rinsed with water (emulsion degreasing method); and a method in which a mixed solution of, for example, sodium carbonate, a phosphate and a surfactant is brought into contact with the aluminum surface at a temperature of from ambient temperature to 50° C. for 30 to 180 seconds, following which the surface is rinsed with water (phosphate method).

The method used for degreasing is preferably one which can remove grease from the aluminum surface but causes substantially no aluminum dissolution. Hence, an organic solvent method, surfactant method, emulsion degreasing method or phosphate method is preferred.

<Mirror-Like Finishing>

Mirror-like finishing is carried out to eliminate surface asperities on the aluminum substrate and improve the uniformity and reproducibility of grain-forming treatment by a process such as electrodeposition. Examples of surface asperities on the aluminum substrate include rolling streaks formed during rolling when the aluminum substrate has been produced by a process including rolling.

In the practice of the invention, mirror-like finishing is not subject to any particular limitation, and may be carried out using any suitable method known in the art. Examples of suitable methods include mechanical polishing, chemical polishing, and electrolytic polishing.

Illustrative examples of suitable mechanical polishing methods include polishing with various commercial abrasive cloths, and methods that combine the use of various commercial abrasives (e.g., diamond, alumina) with buffing. More specifically, a method which is carried out with an abrasive while changing over time the abrasive used from one having coarser particles to one having finer particles is appropriately illustrated. In such a case, the final abrasive used is preferably one having a grit size of 1500. In this way, a glossiness of at least 50% (in the case of rolled aluminum, at least 50% in both the rolling direction and the transverse direction) can be achieved.

Examples of chemical polishing methods include various methods mentioned in the $6^{th}$ edition of Aluminum Handbook (Japan Aluminum Association, 2001), pp. 164-165.

Preferred examples include phosphoric acid/nitric acid method, Alupol I method, Alupol V method, Alcoa R5 method, $H_3PO_4$—$CH_3COOH$—Cu method and $H_3PO_4$—$HNO_3$—$CH_3COOH$ method. Of these, the phosphoric acid/nitric acid method, the $H_3PO_4$—$CH_3COOH$—Cu method and the $H_3PO_4$—$HNO_3$—$CH_3COOH$ method are especially preferred.

With chemical polishing, a glossiness of at least 70% (in the case of rolled aluminum, at least 70% in both the rolling direction and the transverse direction) can be achieved.

Examples of electrolytic polishing methods include various methods mentioned in the $6^{th}$ edition of Aluminum Handbook (Japan Aluminum Association, 2001), pp. 164-165.

A preferred example is the method described in U.S. Pat. No. 2,708,655.

The method described in Jitsumu Hyomen Gijutsu (Practice of Surface Technology), Vol. 33, No. 3, pp. 32-38 (1986) is also preferred.

With electrolytic polishing, a glossiness of at least 70% (in the case of rolled aluminum, at least 70% in both the rolling direction and the transverse direction) can be achieved.

These methods may be suitably combined and used. In a preferred example, a method that uses an abrasive is carried out by changing over time the abrasive used from one having coarser particles to one having finer particles, following which electrolytic polishing is carried out.

Mirror-like finishing enables a surface having, for example, a mean surface roughness $R_a$ of 0.1 μm or less and a glossiness of at least 50% to be obtained. The mean surface roughness $R_a$ is preferably 0.03 μm or less, and more preferably 0.02 μm or less. The glossiness is preferably at least 70%, and more preferably at least 80%.

The glossiness is the specular reflectance which can be determined in accordance with JIS Z8741-1997 (Method 3: 60° Specular Gloss) in a direction perpendicular to the rolling direction. Specifically, measurement is carried out using a variable-angle glossmeter (e.g., VG-1D, manufactured by Nippon Denshoku Industries Co., Ltd.) at an angle of incidence/reflection of 60° when the specular reflectance is 70% or less, and at an angle of incidence/reflection of 20° when the specular reflectance is more than 70%.

<Anodizing Treatment (Preanodizing Treatment)>

Any conventionally known method can be used for anodizing treatment. More specifically, a self-ordering method to be described below is preferably used.

The self-ordering method is a method which enhances the orderliness by using the regularly arranging nature of micropores in the anodized layer and eliminating factors that may disturb an orderly arrangement. Specifically, an anodized layer is formed on high-purity aluminum at a voltage appropriate for the type of electrolytic solution and at a low speed over an extended period of time (e.g., from several hours to well over ten hours).

In this method, because the pore diameter is dependent on the voltage, the desired pore diameter can be obtained to a certain degree by controlling the voltage.

The average flow rate in anodizing treatment is preferably 0.5 to 20.0 m/min, more preferably 1.0 to 15.0 m/min and even more preferably 2.0 to 10.0 m/min. Uniformity and high orderliness can be achieved by performing anodizing treatment at a flow rate within the above range.

The method of flowing the electrolytic solution under the condition described above is not subject to any particular limitation, and a method which uses a general stirring device such as a stirrer may be employed. Use of a stirrer capable of controlling the stirring speed in the digital display mode is preferable because the average flow rate can be controlled. An example of such stirring device includes a magnetic stirrer HS-50D (produced by As One Corporation).

Anodizing treatment may be carried out by, for example, a method that involves passing an electrical current through the aluminum substrate as the anode in a solution having an acid concentration of 1 to 10 wt %. Solutions that may be used in anodizing treatment are preferably acid solutions. It is preferable to use sulfuric acid, phosphoric acid, chromic acid, oxalic acid, sulfamic acid, benzenesulfonic acid and amidosulfonic acid, and more preferably sulfuric acid, phosphoric acid and oxalic acid. These acids may be used singly or in combination of two or more.

The conditions for anodizing treatment vary depending on the electrolytic solution used, and thus cannot be strictly specified. However, it is generally preferable for the electrolyte concentration to be 0.1 to 20 wt %, the temperature of the solution to be −10 to 30° C., the current density to be 0.01 to 20 A/dm$^2$, the voltage to be 3 to 300 V, and the period of electrolysis to be 0.5 to 30 hours. It is more preferable for the electrolyte concentration to be 0.5 to 15 wt %, the temperature of the solution to be −5 to 25° C., the current density to be 0.05 to 15 A/dm$^2$, the voltage to be 5 to 250 V, and the period of electrolysis to be 1 to 25 hours. It is particularly preferable for the electrolyte concentration to be 1 to 10 wt %, the temperature of the solution to be 0 to 20° C., the current density to be 0.1 to 10 A/dm$^2$, the voltage to be 10 to 200 V, and the period of electrolysis to be 2 to 20 hours.

The anodized layer formed has a thickness of preferably 1 to 300 μm, more preferably 5 to 150 μm and even more preferably 10 to 100 μm.

Anodizing treatment is carried out for a period of preferably 0.5 minute to 16 hours, more preferably 1 minute to 12 hours, and even more preferably 2 minutes to 8 hours.

In addition to a method in which anodizing treatment is performed at a constant voltage, another method which involves changing the voltage continuously or intermittently may be used in anodizing treatment. In this case, it is preferable to gradually reduce the voltage. This method enables reduction of the resistance in the anodized layer, thus achieving uniformity in the case where electrodeposition is to be performed later.

The average pore density is preferably from 50 to 1,500 pores/$\mu m^2$.

The area ratio occupied by the micropores is preferably from 20 to 50%. The area ratio occupied by the micropores is defined as the proportion of the sum of the areas of the individual micropore openings to the area of the aluminum surface.

<Pore-Ordering Treatment>

Pore-ordering treatment is a treatment which involves performing one or more cycles of a step that includes a first film dissolution treatment for dissolving 0.001 to 20 wt % of a material constituting the anodized layer and its subsequent anodizing treatment.

<First Film Dissolution Treatment>

The first film dissolution treatment is a treatment in which 0.001 to 20 wt % of the constituent material of the anodized layer in the aluminum member is dissolved. This treatment dissolves part of the irregularly arranged portion on the anodized layer surface and hence enhances the orderliness of the array of the micropores. On the other hand, part of the interior of each micropore in the anodized layer is also dissolved, but at a specified amount of dissolution within the above range, the anodized layer at the bottoms of the micropores remain undissolved to enable the anodized layer to keep having starting points for anodizing treatment to be described later.

Figure 1B:
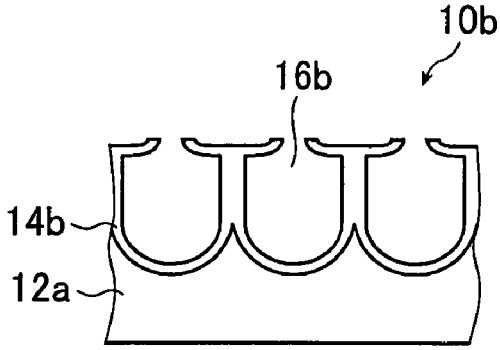

As shown in FIG. 1B, the first film dissolution treatment causes the surface of the anodized layer 14*a* and the interiors of the micropores 16*a* shown in FIG. 1A to dissolve to thereby obtain an aluminum member 10*b* having on the aluminum substrate 12*a* an anodized layer 14*b* bearing micropores 16*b*. The anodized layer 14*b* remain at the bottoms of the micropores 16*b*.

The first film dissolution treatment is performed by bringing the aluminum member into contact with an aqueous acid solution or aqueous alkali solution. The contacting method is not particularly limited and is exemplified by immersion and spraying. Of these, immersion is preferable.

When the first film dissolution treatment is to be carried out with an aqueous acid solution, it is preferable to use an aqueous solution of an inorganic acid such as sulfuric acid, phosphoric acid, nitric acid or hydrochloric acid, or a mixture thereof. It is particularly preferable to use an aqueous solution containing no chromic acid owing to its high security. It is desirable for the aqueous acid solution to have a concentration of 1 to 10 wt % and a temperature of 25 to 40° C.

When the first film dissolution treatment is to be carried out with an aqueous alkali solution, it is preferable to use an aqueous solution of at least one alkali selected from the group consisting of sodium hydroxide, potassium hydroxide and lithium hydroxide. It is preferable for the aqueous alkali solution to have a concentration of 0.1 to 5 wt % and a temperature of 20 to 35° C.

Specific examples of preferred solutions include a 40° C. aqueous solution containing 50 g/L of phosphoric acid, a 30° C. aqueous solution containing 0.5 g/L of sodium hydroxide, and a 30° C. aqueous solution containing 0.5 g/L of potassium hydroxide.

The aluminum member is immersed in the aqueous acid solution or aqueous alkali solution for a period of preferably 8 to 60 minutes, more preferably 10 to 50 minutes, and even more preferably 15 to 30 minutes.

The amount of material dissolved out of the anodized layer in the first film dissolution treatment is 0.001 wt % to 20 wt % and preferably 0.01 wt % to 10 wt % of the weight of the whole anodized layer. Within the above range, irregularly arranged portion on the surface of the anodized layer is dissolved to enhance the orderliness of the array of the micropores, while at the same time the anodized layer at the bottoms of the micropores remain undissolved to keep having starting points for anodizing treatment to be described later.

<Anodizing Treatment>

The first film dissolution treatment is followed by anodizing treatment, which causes the oxidation of the aluminum substrate to proceed to increase the thickness of the anodized layer, part of which has been dissolved by the first film dissolution treatment.

Figure 1C:
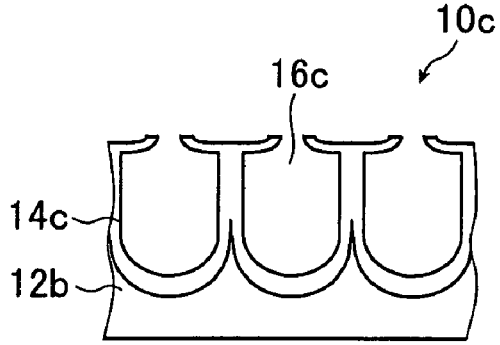

As shown in FIG. 1C, anodizing treatment causes the oxidation of the aluminum substrate 12*a* shown in FIG. 1B to proceed to obtain an aluminum member 10*c* that has on an aluminum substrate 12*b* deeper micropores 16*c* than the micropores 16*b* and a thicker anodized layer 14*c* than the anodized layer 14*b*.

Anodizing treatment may be carried out using a method known in the art, although it is preferably carried out under the same conditions as the above-described self-ordering method.

Suitable use can also be made of a method in which the current is repeatedly turned on and off in an intermittent manner while keeping the dc voltage constant, and a method in which the current is repeatedly turned on and off while intermittently changing the dc voltage. Because these methods enables formation of micropores in the anodized layer, they are preferable for improving uniformity, particularly when sealing is carried out by electrodeposition.

In the above method in which the voltage is intermittently changed, it is preferable to gradually reduce the voltage. It is possible in this way to lower the resistance in the anodized layer, enabling uniformity to be achieved when electrodeposition is subsequently carried out.

The thickness of the anodized layer is preferably increased by 0.001 to 0.3 μm and more preferably 0.01 to 0.1 μm. Within the above range, the orderliness of the array of the pores can be more enhanced.

In pore-ordering treatment, one or more cycles of the step that includes the first film dissolution treatment and its subsequent anodizing treatment as described above are performed. The larger the number of repetitions is, the more the orderliness of the array of the pores is enhanced. In this regard, this step is repeatedly performed preferably twice or more, more preferably three times or more, and even more preferably four times or more.

When this step is repeatedly performed twice or more in pore-ordering treatment, the conditions of the first film dissolution treatment and the anodizing treatment in the respective cycles may be the same or different.

It should be noted that, when this step is repeatedly performed twice or more, the amount of anodized layer dissolution in the first film dissolution treatment in the nth (n is at least 2) cycle is determined with reference to the anodized layer having undergone the anodizing treatment of the previous cycle.

<Second Film Dissolution Treatment>

Pore-ordering treatment described above is followed by the second film dissolution treatment, which causes the surface of the anodized layer to dissolve to obtain a microstructure having a highly ordered array of micropores.

Figure 1D:
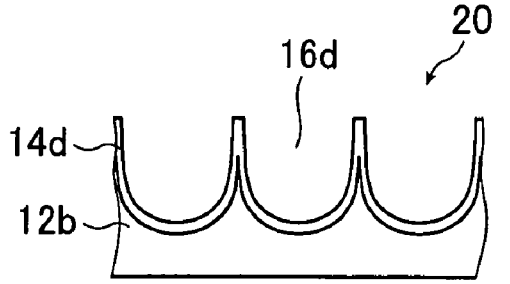

As shown in FIG. 1D, the second film dissolution treatment causes the surface of the anodized layer 14*c* and the interiors of the micropores 16*c* shown in FIG. 1C to dissolve to thereby obtain a microstructure 20 having on the aluminum substrate 12*b* and anodized layer 14*d* bearing micropores 16*d*. In FIG. 1D, the anodized layer 14*d* remain on the aluminum substrate 12*b*, but may be entirely dissolved in the second film dissolution treatment. When the anodized layer has been entirely dissolved, pits which are present on the surface of the aluminum substrate serve as micropores of the microstructure.

The second film dissolution treatment may be basically performed on the same conditions as those in the first film dissolution treatment, so differences are only described below.

The amount of material dissolved out of the anodized layer in the second film dissolution treatment is not particularly limited and is preferably 0.01 to 30 wt % and more preferably 0.1 to 15 wt %.

In the second film dissolution treatment, the aluminum member is immersed in the aqueous acid solution or aqueous alkali solution for a period of preferably 8 to 90 minutes, more preferably 10 to 60 minutes and even more preferably 15 to 45 minutes.

<Microstructure>

The manufacturing method of the invention yields the microstructure of the invention.

The average pore density of the microstructure of the invention is preferably from 50 to 1,500 pores/$\mu m^2$.

The area ratio occupied by the micropores in the microstructure of the invention is preferably from 20 to 50%.

In addition, the microstructure of the invention has preferably the micropores with a degree of ordering as defined by the formula (1):

$$\text{Degree of Ordering (\%)} = B/A \times 100 \quad (1)$$

(wherein A represents the total number of micropores in a measurement region; and B represents the number of specific micropores in the measurement region for which, when a circle is drawn so as to be centered on the center of gravity of a specific micropore and so as to be of the smallest radius that is internally tangent to the edge of another micropore, the circle includes the centers of gravity of six micropores other than the specific micropore) of at least 50%.

Figure 2A:
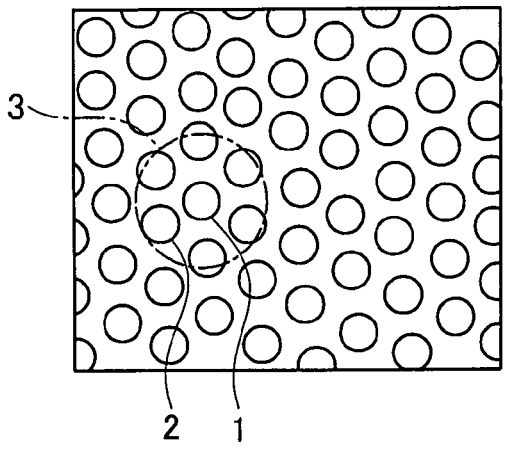
FIGS. 2A and 2B are views illustrating a method for computing the degree of ordering of pores.
Figure 2B:
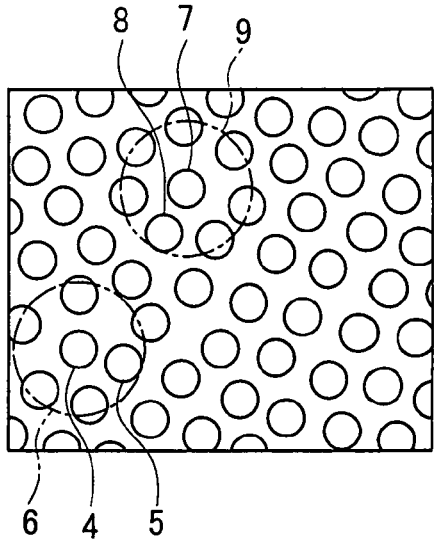

FIGS. 2A and 2B are views illustrating a method for computing the degree of ordering of pores. The computation method is explained more fully below in conjunction with FIGS. 2A and 2B.

With regard to a micropore 1 shown in FIG. 2A, when a circle 3 is drawn so as to be centered on the center of gravity of the micropore 1 and so as to be of the smallest radius that is internally tangent to the edge of another micropore (inscribed in a micropore 2), the interior of the circle 3 includes the centers of gravity of six micropores other than the micropore 1. Therefore, the micropore 1 is counted for B.

With regard to a micropore 4 shown in FIG. 2B, when a circle 6 is drawn so as to be centered on the center of gravity of the micropore 4 and so as to be of the smallest radius that is internally tangent to the edge of another micropore (inscribed in a micropore 5), the interior of the circle 6 includes the centers of gravity of five micropores other than micropore 4. Therefore, micropore 4 is not counted for B. With regard to a micropore 7 shown in FIG. 2B, when a circle 9 is drawn so as to be centered on the center of gravity of the micropore 7 and so as to be of the smallest radius that is internally tangent to the edge of another micropore (inscribed in a micropore 8), the interior of the circle 9 includes the centers of gravity of seven micropores other than the micropore 7. Therefore, the micropore 7 is not counted for B.

<Other Treatment>

Other treatments may be performed as needed.

For example, when the microstructure of the invention is to be used as a sample holder on which an aqueous solution will be deposited to form a film, hydrophilizing treatment may be performed to reduce the contact angle with water. Such hydrophilizing treatment may be performed by a method known in the art.

Alternatively, when the inventive microstructure is to be used as a sample holder for protein that will be denatured or decomposed with acid, neutralizing treatment may be performed to neutralize acids that are used in pore widening treatment and remain as residues on the aluminum surface. Such neutralizing treatment may be performed by a method known in the art.

In the microstructure of the invention, the aluminum substrate may be removed depending on the intended application.

The method of removing the aluminum substrate is not subject to any particular limitation, and it is preferable to use, for example, a method in which the aluminum substrate is immersed in a solvent in which alumina is hardly soluble or insoluble but aluminum is soluble.

Preferred solvents that may be used include halogen solvents (e.g., bromine and iodine); acidic solvents such as dilute sulfuric acid, phosphoric acid, oxalic acid, sulfamic acid, benzenesulfonic acid and amidosulfonic acid; and alkaline solvents such as sodium hydroxide, potassium hydroxide and calcium hydroxide. Bromine and iodine are particularly preferable.

The microstructure of the invention may support a catalyst in the micropores of the anodized layer according to the intended application.

The catalyst is not subject to any particular limitation as long as the catalyst used has a catalytic function, and examples of the catalyst that may be used include $AlCl_3$, $AlBr_3$, $Al_2O_3$, $SiO_2$, $SiO_2$—$Al_2O_3$, silicon zeolite, $SiO_2$—NiO, active carbon, $PbO/Al_2O_3$, $LaCoO_3$, $H_3PO_4$, $H_4P_2O_7$, $Bi_2O_3$—$MoO_3$, $Sb_2O_5$, $SbO_5$—$Fe_2O_3$, $SnO_2$—$Sb_2O_5$, Cu, $CuO_2$—$Cr_2O_3$, Cu—$Cr_2O_3$—ZnO, $Cu/SiO_2$, $CuCl_2$, Ag/α—$Al_2O_3$, Au, ZnO, ZnO—$Cr_2O_3$, $ZnCl_2$, ZnO—$Al_2O_3$—CaO, $TiO_2$, $TiCl_4.Al(C_2H_5)_3$, $Pt/TiO_2$, $V_2O_5$, $V_2O_5$—$P_2O_5$, $V_2O_5/TiO_2$, $Cr_2O_3$, $Cr_2O_3/Al_2O_3$, $MoO_3$, $MoO_3$—$SnO_2$, Co.Mo/$Al_2O_3$, Ni.Mo/$Al_2O_3$, $MoS_2$, Mo—Bi—O, $MoO_3$—$Fe_2O_3$, $H_3PMo_{12}O_{40}$, $WO_3$, $H_3PW_{12}O_{40}$, $MnO_2$, Fe—$K_2O$—$Al_2O_3$, $Fe_2O_3$—$Cr_2O_3$, $Fe_2O_3$—$Cr_2O_3$—$K_2O$, $Fe_2O_3$, Co, cobalt/active carbon, $CO_3O_4$, cobalt carbonyl complex, Ni, Raney nickel, nickel/support, modified nickel, Pt, $Pt/Al_2O_3$, Pt—Rh—Pd/support, Pd, $Pd/SiO_2$, $Pd/Al_2O_3$, $PdCl_2$—$CuCl_2$, Re, Re—$Pt/Al_2O_3$, $Re_2O_7/Al_2O_3$, Ru, $Ru/Al_2O_3$, Rh, and rhodium complex.

The method of supporting the catalyst is not particularly limited but any conventionally known technique may be used.

Examples of preferred techniques include electrodeposition, and a method which involves coating the aluminum member having the anodized layer with a dispersion of catalyst particles, then drying. The catalyst is preferably in the form of single particles or agglomerates.

An electrodeposition method known in the art may be used. For example, in the case of gold electrodeposition, use may be made of a process in which the aluminum member is immersed in a 30° C. dispersion containing 1 g/L of $HAuCl_4$ and 7 g/L of $H_2SO_4$ and electrodeposition is carried out at a constant voltage of 11 V (regulated with an autotransformer such as SLIDAC) for 5 to 6 minutes.

An example of the electrodeposition method which employs copper, tin and nickel is described in detail in Gendai Kagaku (Contemporary Chemistry), pp. 51-54 (January 1997)). Use can be made of this method as well.

The dispersions employed in methods which use catalyst particles can be obtained by a conventionally known method. Illustrative examples include methods of preparing fine particles by low-vacuum vapor deposition and methods of preparing catalyst colloids by reducing an aqueous solution of a catalyst salt.

The catalyst colloidal particles have an average particle size of preferably 1 to 200 nm, more preferably 1 to 100 nm, and even more preferably 2 to 80 nm.

Preferred use can be made of water as the dispersion medium employed in the dispersion. Use can also be made of a mixed solvent composed of water and a solvent that is miscible with water, such as an alcohol, illustrative examples of which include ethyl alcohol, n-propyl alcohol, i-propyl alcohol, 1-butyl alcohol, 2-butyl alcohol, t-butyl alcohol, methyl cellosolve and butyl cellosolve.

No particular limitation is imposed on the technique used for coating the aluminum member with the dispersion of catalyst colloidal particles. Suitable examples of such techniques include bar coating, spin coating, spray coating, curtain coating, dip coating, air knife coating, blade coating and roll coating.

Preferred examples of dispersions that may be employed in methods which use catalyst colloidal particles include dispersions of gold colloidal particles and dispersions of silver colloidal particles.

Dispersions of gold colloidal particles that may be used include those described in JP 2001-89140 A and JP 11-80647 A. Use can also be made of commercial products.

Dispersions of silver colloidal particles preferably contain particles of silver-palladium alloys because these are not affected by the acids which leach out of the anodized layer. The palladium content in such a case is preferably from 5 to 30 wt %.

Application of the dispersion is followed by cleaning that may be appropriately performed using a solvent such as water. As a result of such cleaning, only the catalyst particles supported in the micropores remain in the anodized layer whereas catalyst particles that have not been supported in the micropores are removed.

The amount of supported catalyst is preferably 10 to 1,000 $mg/m^2$, more preferably 50 to 800 $mg/m^2$ and even more preferably 100 to 500 $mg/m^2$.

The surface porosity after catalyst supporting treatment is preferably not more than 70%, more preferably not more than 50% and even more preferably not more than 30%. The surface porosity after catalyst supporting treatment is defined as the sum of the areas of the openings in micropores having no catalyst supported therein relative to the area of the aluminum surface.

Catalyst colloidal particles which may be used in the dispersion generally have a dispersion in the particle size distribution, expressed as the coefficient of variation, of about 10 to 20%. In the practice of the invention, by setting the dispersion in pore size within a specific range, colloidal particles with dispersed particle size distribution can be efficiently used for sealing.

When the pore size is 50 nm or more, suitable use can be made of a method which employs catalyst colloidal particles. When the pore size is less than 50 nm, suitable use can be made of an electrodeposition process. Suitable use can also be made of a method which combines both approaches.

The microstructure of the invention has regularly arranged micropores, and can therefore be employed in various applications.

EXAMPLES

Examples are given below by way of illustration and should not be construed as limiting the invention.

1. Fabrication of Microstructure

Examples 1 to 30 And Comparative Examples 1 to 3

The respective microstructures were obtained by subjecting the substrates, as shown in Table 1, to the following treatments: The substrates were sequentially subjected to mirror-like finishing and preanodizing treatment, which were followed by pore-ordering treatment in Examples 1 to 30 or film removal treatment and its subsequent anodizing treatment in Comparative Examples 1 to 3; the second film dissolution treatment was then performed. In Table 1, a dash (-) indicates that the treatment in question was not carried out.

TABLE 1

| | | | | | | Pore-ordering condition | | Number of repeti- | 2nd film | Degree |
|---|---|---|---|---|---|---|---|---|---|---|
| | Sub-strate | Mirror-like finishing | Pre-anodizing condition | Film removal condition | Anodizing condition | 1st film dissolution condition | Anodizing condition | tions of pore-ordering | disso-lution condition | or ordering (%) |
| EX1 | 1 | Yes | 1 | — | — | 91 | 81 | 1 | 101 | 40 |
| EX2 | 1 | Yes | 2 | — | — | 91 | 82 | 1 | 101 | 42 |
| EX3 | 1 | Yes | 3 | — | — | 91 | 83 | 1 | 101 | 40 |
| EX4 | 1 | Yes | 4 | — | — | 91 | 84 | 1 | 101 | 40 |
| EX5 | 1 | Yes | 5 | — | — | 91 | 85 | 2 | 101 | 62 |
| EX6 | 1 | Yes | 6 | — | — | 91 | 86 | 2 | 101 | 62 |
| EX7 | 1 | Yes | 7 | — | — | 92 | 87 | 2 | 102 | 63 |
| EX8 | 2 | Yes | 8 | — | — | 92 | 88 | 2 | 102 | 66 |
| EX9 | 2 | Yes | 9 | — | — | 92 | 89 | 3 | 102 | 78 |
| EX10 | 2 | Yes | 10 | — | — | 92 | 90 | 3 | 102 | 77 |
| EX11 | 2 | Yes | 1 | — | — | 92 | 81 | 3 | 102 | 77 |
| EX12 | 2 | Yes | 2 | — | — | 92 | 82 | 3 | 102 | 79 |
| EX13 | 2 | Yes | 3 | — | — | 92 | 83 | 4 | 102 | 42 |
| EX14 | 2 | Yes | 4 | — | — | 92 | 84 | 4 | 102 | 42 |
| EX15 | 3 | Yes | 5 | — | — | 92 | 85 | 1 | 102 | 41 |
| EX16 | 3 | Yes | 6 | — | — | 92 | 86 | 1 | 102 | 40 |
| EX17 | 3 | Yes | 7 | — | — | 92 | 87 | 1 | 102 | 40 |

TABLE 1-continued

| | Substrate | Mirror-like finishing | Pre-anodizing condition | Film removal condition | Anodizing condition | Pore-ordering condition: 1st film dissolution condition | Pore-ordering condition: Anodizing condition | Number of repetitions of pore-ordering | 2nd film dissolution condition | Degree or ordering (%) |
|---|---|---|---|---|---|---|---|---|---|---|
| EX18 | 3 | Yes | 8 | — | — | 92 | 88 | 1 | 102 | 44 |
| EX19 | 3 | Yes | 9 | — | — | 92 | 89 | 2 | 102 | 66 |
| EX20 | 3 | Yes | 10 | — | — | 92 | 90 | 2 | 102 | 64 |
| EX21 | 3 | Yes | 1 | — | — | 92 | 81 | 2 | 102 | 64 |
| EX22 | 4 | Yes | 2 | — | — | 91 | 82 | 2 | 101 | 65 |
| EX23 | 5 | Yes | 3 | — | — | 91 | 83 | 3 | 101 | 74 |
| EX24 | 6 | Yes | 4 | — | — | 91 | 84 | 3 | 101 | 77 |
| EX25 | 7 | No | 5 | — | — | 91 | 85 | 3 | 101 | 78 |
| EX26 | 8 | No | 6 | — | — | 92 | 86 | 3 | 101 | 71 |
| EX27 | 9 | No | 7 | — | — | 92 | 87 | 4 | 102 | 94 |
| EX28 | 10 | No | 8 | — | — | 92 | 88 | 4 | 102 | 95 |
| EX29 | 11 | No | 9 | — | — | 92 | 89 | 4 | 102 | 90 |
| EX30 | 12 | No | 10 | — | — | 92 | 90 | 4 | 102 | 91 |
| CE1 | 1 | Yes | 1 | 51 | 71 | — | — | — | 103 | 30 |
| CE2 | 1 | Yes | 5 | 52 | 72 | — | — | — | 103 | 31 |
| CE3 | 2 | Yes | 7 | 53 | 73 | — | — | — | 103 | 29 |

The substrate and the respective treatments are described in detail below.

(1) Substrate

The substrates used to manufacture the microstructures were fabricated as described below. These were cut and used so as to enable anodizing treatment to be carried out over an area of 10 cm square.

Substrate 1: High-purity aluminum. Produced by Wako Pure Chemical Industries, Ltd. Purity, 99.99 wt %; thickness, 0.4 mm.

Substrate 2: Aluminum JIS A1050 material provided with Surface Layer A. Produced by Nippon Light Metal Co., Ltd. Purity, 99.5 wt %; thickness, 0.24 mm.

Substrate 3: Aluminum JIS A1050 material provided with Surface Layer B. Produced by Nippon Light Metal Co., Ltd. Purity, 99.5 wt %; thickness, 0.24 mm.

Substrate 4: Aluminum JIS A1050 material. Produced by Nippon Light Metal Co., Ltd. Purity, 99.5 wt %; thickness, 0.30 mm.

Substrate 5: Aluminum JIS A1050 material provided with Surface Layer C. Produced by Nippon Light Metal Co., Ltd. Purity, 99.5 wt %; thickness, 0.30 mm.

Substrate 6: Aluminum JIS A1050 material provided with Surface Layer D. Produced by Nippon Light Metal Co., Ltd. Purity, 99.5 wt %; thickness, 0.30 mm.

Substrate 7: Aluminum vapor-deposited film. Torayfan AT80, produced by Toray Industries, Inc. Purity, 99.9 wt %; thickness, 0.02 mm.

Substrate 8: Aluminum XL untreated material provided with Surface Layer A. Produced by Sumitomo Light Metal Industries, Ltd. Purity, 99.3 wt %; thickness, 0.30 mm.

Substrate 9: Glass provided with Surface Layer E. Produced by As One Corporation. Purity, 99.9 wt %; thickness, 5 mm.

Substrate 10: Silicon wafer provided with Surface Layer E. Produced by Shin-Etsu Chemical Co., Ltd. Purity, ≧99.99 wt %.

Substrate 11: Synthetic quartz provided with Surface Layer E. VIOSIL-SG-2B, produced by Shin-Etsu Chemical Co., Ltd. Purity, ≧99.99 wt %; thickness, 0.6 mm.

Substrate 12: A copper-clad laminate provided with Surface Layer E (RAS33S42, produced by Shin-Etsu Chemical Co., Ltd.; purity, unknown; thickness, 0.08 mm), on the surface of which an aluminum-copper alloy film was formed by sputtering.

The above aluminum JIS A1050 material had a specular reflectance in the vertical direction of 40% (standard deviation, 10%), a specular reflectance in the horizontal direction of 15% (standard deviation, 10%), and a purity of 99.5 wt % (standard deviation, 0.1 wt %).

The above aluminum XL untreated material had a specular reflectance in the vertical direction of 85% (standard deviation, 5%), a specular reflectance in the horizontal direction of 83% (standard deviation, 5%), and a purity of 99.3 wt % (standard deviation, 0.1 wt %).

Surface Layers A to E were prepared as follows.

Surface Layer A was formed on the substrate by vacuum deposition under the following conditions: ultimate pressure, $4\times10^{-6}$ Pa; deposition current, 40 A; substrate heating to 150° C.; deposition material, aluminum wire having a purity of 99.9 wt % (The Nilaco Corporation). Surface Layer A had a thickness of 0.2 μm.

Surface Layer B was formed by the same method as Surface Layer A, except that aluminum wire having a purity of 99.99 wt % (The Nilaco Corporation) was used as the deposition material. Surface Layer B had a thickness of 0.2 μm.

Surface Layer C was formed on the substrate by sputtering under the following conditions: ultimate pressure, $4\times10^{-6}$ Pa; sputtering pressure, $10^{-2}$ Pa; argon flow rate, 20 sccm; substrate controlled to 150° C. (with cooling); no bias; sputtering power supply, RC; sputtering power, RF 400 W; sputtering material, 3N backing plate with a purity of 99.9 wt % (produced by Kyodo International, Inc.). Surface Layer C had a thickness of 0.5 μm.

Surface Layer D was formed by the same method as Surface Layer C, except for the use as the sputtering material of 4N backing plate with a purity of 99.99 wt % (Kyodo International, Inc.). Surface Layer D had a thickness of 0.5 μm.

Surface layer E was formed by the same method as Surface Layer A, except that the thickness was set to 1 μm.

The thickness of the surface layer was adjusted as follows. First, masking was carried out on a PET substrate, and vacuum deposition and sputtering were carried out under the same conditions as indicated above but for varying lengths of time. The film thickness in each case was then measured with an atomic force microscope (AFM), and a calibration curve correlating the resulting times and film thicknesses was prepared. Based on the calibration curve, the vacuum deposition or sputtering time was adjusted to achieve the desired surface layer thickness.

The purity of the surface layer was determined by carrying out a full quantitative analysis with a scanning ESCA microprobe (Quantum 2000; manufactured by Ulvac-Phi, Inc.) while etching in the depth direction with an ion gun, then quantitatively determining the contents of the dissimilar metallic elements by the calibration curve method. As a result, each of the surface layers had substantially the same purity as the purity of the deposition material or the sputtering material.

(2) Mirror-Like Finishing Treatment

Of the above Substrates 1 to 12, Substrates 1 to 6 were subjected to the following mirror-like finishing treatment.

<Mirror-Like Finishing>

In mirror-like finishing, polishing with an abrasive cloth, buffing, then electrolytic polishing were carried out in this order. After buffing, the substrate was rinsed with water.

Polishing with an abrasive cloth was carried out using a polishing platen (Abramin, produced by Marumoto Struers K.K.) and commercial water-resistant abrasive cloths. This polishing operation was carried out while successively changing the grit size of the water-resistant abrasive cloths in the following order: #200, #500, #800, #1000 and #1500.

Buffing was carried out using slurry-type abrasives (FM No. 3 (average particle size, 1 μm) and FM No. 4 (average particle size, 0.3 μm), both made by Fujimi Incorporated).

Electrolytic polishing was carried out for 2 minutes using an electrolytic solution of the composition indicated below (temperature, 70° C.), using the substrate as the anode and a carbon electrode as the cathode, and at a constant current of 130 mA/cm$^2$. The power supply was a GP0110-30R unit manufactured by Takasago, Ltd.

| <Electrolytic Solution Composition> | |
|---|---|
| 85 wt % Phosphoric acid (Wako Pure Chemical Industries, Ltd.) | 660 mL |
| Pure water | 160 mL |
| Sulfuric acid | 150 mL |
| Ethylene glycol | 30 mL |

Preanodizing treatment was performed under the conditions shown in Table 1 on the surfaces of Substrates 1 to 6 which had been mirror-like finished and on the surfaces of Substrates 7 to 12 which had not been mirror-like finished.

The conditions of preanodizing treatment shown in Table 1 is shown in further detail in Table 2. More specifically, self-ordering anodizing treatment was carried out in the substrate immersed in the electrolytic solution according to such conditions as the type, concentration, average flow rate and temperature of the electrolytic solution, voltage, current density and treatment time shown in Table 2, thereby forming the anodized layer of the film thickness shown in Table 2. In self-ordering anodizing treatment, use was made of NeoCool BD36 (Yamato Scientific Co., Ltd.) as the cooling system, Pairstirrer PS-100 (Tokyo Rikakikai Co., Ltd.) as the stirring and warming unit, and a GP0650-2R unit (Takasago, Ltd.) as the power supply. The average flow rate of the electrolytic solution was measured using the vortex flow monitor FLM22-10PCW (manufactured by As One Corporation).

The anodized layer thickness was measured using the eddy current thickness gauge EDY-1000 (manufactured by Sanko Electronic Laboratory Co., Ltd.).

TABLE 2

| Condition | Type of electrolytic solution | Concentration of electrolytic solution (mol/L) | Average flow rate of electrolytic solution (m/min) | Temperture of electrolytic solution (° C.) | Voltage (V) | Current density (A/dm$^2$) | Treatment time (hr) | Film thickness (μm) |
|---|---|---|---|---|---|---|---|---|
| 1 | phosphoric acid | 0.3 | 18.0 | 7 | 150 | 0.30 | 8.0 | 50 |
| 2 | phosphoric acid | 0.3 | 6.0 | 7 | 150 | 0.30 | 8.0 | 50 |
| 3 | phosphoric acid | 1.0 | 1.0 | 7 | 150 | 0.30 | 8.0 | 50 |
| 4 | phosphoric acid | 1.0 | 0.3 | 7 | 150 | 0.30 | 8.0 | 50 |
| 5 | oxalic acid | 0.3 | 5.0 | 20 | 40 | 2.40 | 1.5 | 40 |
| 6 | oxalic acid | 0.3 | 0.3 | 20 | 40 | 2.40 | 1.5 | 40 |
| 7 | sulfuric acid | 0.3 | 18.0 | 15 | 25 | 2.00 | 7.0 | 140 |
| 8 | sulfuric acid | 0.3 | 6.0 | 15 | 25 | 2.00 | 7.0 | 140 |
| 9 | sulfuric acid | 0.3 | 1.0 | 15 | 25 | 2.00 | 7.0 | 140 |
| 10 | phosphoric acid | 1.0 | 0.3 | 7 | 150 | 0.30 | 0.5 | <1 |

In Table 2, the phosphoric acid, oxalic acid and sulfuric acid used were all reagents available from Kanto Chemical Co., Inc. The current density indicates the value when stable.

(4) Film Removal Treatment

In Comparative Examples 1 to 3, preanodizing treatment was followed by film removal treatment under the conditions shown in Table 1 to remove the anodized layer.

The film removal conditions shown in Table 1 are shown in further detail in Table 3. More specifically, the aluminum members having the anodized layers were immersed in the treatment solutions of the compositions and temperatures shown in Table 3 for the length of time shown in Table 3.

TABLE 3

| Condition | 85 wt % Phosphoric acid (g) | Chromic anhydride (g) | Pure water (g) | Temperature (° C.) | Time (hr) |
|---|---|---|---|---|---|
| 51 | 100 | 30 | 1,500 | 30 | 5 |
| 52 | 100 | 30 | 1,500 | 50 | 5 |
| 53 | 75 | 30 | 1,500 | 50 | 5 |

In Table 3, the 85 wt % phosphoric acid and the chromic anhydride used were both reagents available from Kanto Chemical Co., Inc. The treatment solution used in Condition 53 had the composition specified in JIS H8688 (1998)-H8688.

(5) Anodizing Treatment

In Comparative Examples 1 to 3, film removal treatment was followed by anodizing treatment under the conditions shown in Table 1.

The conditions of anodizing treatment following film removal treatment as shown in Table 1 are shown in further detail in Table 4. More specifically, each aluminum member having undergone film removal treatment was immersed in the electrolytic solution of the type, concentration, average flow rate and temperature shown in Table 4 to perform electrolysis according to such conditions as the voltage, current density and treatment time shown in Table 4, thereby forming the anodized layer of the film thickness shown in Table 4.

The anodized layer thickness was measured by the same method as above.

(6) Pore-Ordering Treatment

In Examples 1 to 30, pore-ordering treatment which involved performing one or more cycles of a step that included a first film dissolution treatment for dissolving part of the anodized layer having undergone preanodizing treatment and its subsequent anodizing treatment were performed under the conditions shown in Table 1. The number of repetitions of pore-ordering treatment was as shown in Table 1.

The conditions of the first film dissolution treatment shown in Table 1 are shown in further detail in Table 5. More specifically, each aluminum member having the anodized layer was immersed in the treatment solution of the type, concentration and temperature shown in Table 5. The ratio of the material dissolved out of the anodized layer by the first film dissolution treatment is shown in Table 5.

TABLE 7

| Condition | Type of treatment solution | Concentration of treatment solution (g/L) | Temperature (° C.) | Time (min) | Amount of film dissolution (wt %) |
|---|---|---|---|---|---|
| 91 | phosphoric acid | 50 | 40 | 15 | 18 |
| 92 | phosphoric acid | 50 | 30 | 15 | 9 |

The anodizing conditions in pore-ordering treatment shown in Table 1 are shown in further detail in Table 6. More specifically, each aluminum member having undergone film removal treatment was immersed in the electrolytic solution of the type, concentration, average flow rate and temperature shown in Table 6 to perform electrolysis according to such conditions as the voltage, current density and treatment time shown in Table 6. The anodized layer was thus grown to the thickness shown in Table 6.

The anodized layer thickness was measured by the same method as above.

TABLE 4

| Condition | Type of electrolytic solution | Concentration of electrolytic solution (mol/L) | Average flow rate of electrolytic solution (m/min) | Temperature of electrolytic solution (° C.) | Voltage (V) | Current density (A/dm$^2$) | Treatment time (hr) | Film thickness (mm) |
|---|---|---|---|---|---|---|---|---|
| 71 | phosphoric acid | 0.3 | 18.0 | 7 | 150 | 0.30 | 10 | 0.05 |
| 72 | oxalic acid | 0.3 | 5.0 | 20 | 40 | 2.40 | 15 | 0.05 |
| 73 | sulfuric acid | 0.3 | 18.0 | 15 | 25 | 2.00 | 7 | 0.15 |

TABLE 6

| Condition | Type of electrolytic solution | Concentration of electrolytic solution (mol/L) | Average flow rate of electrolytic solution (m/min) | Temperature of electrolytic solution (° C.) | Voltage (V) | Current density (A/dm$^2$) | Treatment time (hr) | Film thickness (mm) |
|---|---|---|---|---|---|---|---|---|
| 81 | phosphoric acid | 0.3 | 18.0 | 7 | 150 | 0.30 | 10 | 0.005 |
| 82 | phosphoric acid | 0.3 | 6.0 | 7 | 150 | 0.30 | 100 | 0.050 |
| 83 | phosphoric acid | 1.0 | 1.0 | 7 | 150 | 0.30 | 500 | 0.250 |
| 84 | phosphoric acid | 1.0 | 0.3 | 7 | 150 | 0.30 | 500 | 0.250 |
| 85 | oxalic acid | 0.3 | 5.0 | 20 | 40 | 2.40 | 15 | 0.005 |
| 86 | oxalic acid | 0.3 | 0.3 | 20 | 40 | 2.40 | 150 | 0.050 |
| 87 | sulfuric acid | 0.3 | 18.0 | 15 | 25 | 2.00 | 7 | 0.015 |
| 88 | sulfuric acid | 0.3 | 6.0 | 15 | 25 | 2.00 | 70 | 0.150 |
| 89 | sulfuric acid | 0.3 | 1.0 | 15 | 25 | 2.00 | 70 | 0.150 |
| 90 | sulfuric acid | 1.0 | 0.3 | 15 | 25 | 2.00 | 70 | 0.150 |

(7) Second Film Dissolution Treatment

The second film dissolution treatment was performed under the conditions shown in Table 1 after pore-ordering treatment in Examples 1 to 30 and after anodizing treatment in Comparative Examples 1 to 3 to thereby obtain the microstructures.

The conditions of the second film dissolution treatment shown in Table 1 are shown in further detail in Table 7. More specifically, each aluminum member having the anodized layer was immersed in the treatment solution of the type, concentration and temperature shown in Table 7 for the length of time shown in Table 7.

TABLE 7

| Condition | Type of treatment solution | Concentration of treatment solution (g/L) | Temperature (° C.) | Time (min) |
|---|---|---|---|---|
| 101 | phosphoric acid | 50 | 30 | 30 |
| 102 | phosphoric acid | 50 | 20 | 30 |
| 103 | phosphoric acid | 50 | 30 | 15 |

2. Surface Property of Microstructure

Surface images of the resulting microstructures were taken with a field emission scanning electron microscope (FE-SEM) at a magnification of 20,000× and the degree of ordering of the micropores as defined by the formula (1) was measured with a field of view of 100 nm×100 nm. The degree of ordering was measured at ten points and the average of the measurements was calculated. The results are shown in Table 1.

As is clear from Table 1, the inventive method of manufacturing microstructures (as in Examples 1 to 30) does not require film removal treatment with a mixed aqueous solution of phosphoric acid and chromic acid and can therefore provide microstructures having highly ordered arrays of pores in a short period of time compared with the case where film removal treatment is performed (as in Comparative Examples 1 to 3).

What is claimed is:

1. A method of manufacturing a microstructure wherein an aluminum member having an aluminum substrate and a micropore-bearing anodized layer present on a surface of the aluminum substrate is subjected at least to, in order, a pore-ordering treatment which involves performing one or more cycles of a step that includes a first film dissolution treatment for dissolving 9 to 20 wt % of a material constituting the anodized layer and an anodizing treatment which follows the first film dissolution treatment; and a second film dissolution treatment for dissolving 9 to 30 wt% of a material constituting the anodized layer, thereby obtaining the microstructure having micropores formed on a surface thereof.

2. A microstructure obtained by the manufacturing method according to claim 1.

3. The microstructure according to claim 2, wherein a degree of ordering of the micropores as defined by a formula (1):

$$\text{Degree of Ordering (\%)} = B/A \times 100 \quad (1)$$

(wherein A represents a total number of micropores in a measurement region; and B represents a number of specific micropores in the measurement region for which, when a circle is drawn so as to be centered on a center of gravity of a specific micropore and so as to be of a smallest radius that is internally tangent to an edge of another micropore, the circle includes centers of gravity of six micropores other than the specific micropore) is at least 50%.

* * * * *